US012104888B2

(12) United States Patent
Fisher

(10) Patent No.: US 12,104,888 B2
(45) Date of Patent: Oct. 1, 2024

(54) DOUBLE SINGLE BEVELED BROADHEAD

(71) Applicant: Mahana Fisher, Saint George, UT (US)

(72) Inventor: Mahana Fisher, Saint George, UT (US)

( * ) Notice: Subject to any disclaimer, the term of this patent is extended or adjusted under 35 U.S.C. 154(b) by 31 days.

(21) Appl. No.: 18/166,474

(22) Filed: Feb. 8, 2023

(65) Prior Publication Data

US 2023/0251069 A1 Aug. 10, 2023

Related U.S. Application Data

(60) Provisional application No. 63/307,975, filed on Feb. 8, 2022.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | | |
|---|---|---|---|---|---|
| 2,676,017 | A * | 4/1954 | Selent | F42B 6/08 | 473/583 |
| 2,880,000 | A * | 3/1959 | Unger | F42B 6/08 | 473/584 |
| 4,234,191 | A * | 11/1980 | Erlandson | F42B 6/08 | 473/583 |
| 5,137,282 | A * | 8/1992 | Segar | F42B 6/08 | 473/583 |
| 9,863,744 | B2 * | 1/2018 | Allison | F42B 6/08 | |
| 10,866,074 | B1 * | 12/2020 | Morton | F42B 6/08 | |
| 2009/0233742 | A1 * | 9/2009 | Sanford | F42B 6/08 | 29/428 |
| 2021/0270584 | A1 * | 9/2021 | Jonsson | F42B 6/08 | |

* cited by examiner

*Primary Examiner* — John A Ricci
(74) *Attorney, Agent, or Firm* — Superior IP, PLLC; Dustin L. Call

(57) ABSTRACT

A double single beveled broadhead. The double single beveled broadhead includes a first pair of blades. The first pair of blades are in a single plane, are opposite one another, forming a wedge shape and are both single beveled. The double single beveled broadhead also includes a second pair of blades. The second pair of blades are in a single plane, the plane of the second pair of blades is offset relative to plane of the first pair of blades by 90 degrees and are both single beveled. The double single beveled broadhead further includes an attachment, where the attachment allows the double single beveled broadhead to be attached to an arrow shaft.

18 Claims, 6 Drawing Sheets

DOUBLE SINGLE BEVELED BROADHEAD

CROSS-REFERENCE TO RELATED APPLICATIONS

This application claims the benefit of and priority to U.S. Provisional Patent Application Ser. No. 63/307,975 filed on Feb. 8, 2022, which application is incorporated herein by reference in its entirety.

BACKGROUND OF THE INVENTION

There are a number of drawbacks in traditional broadhead designs. For example, a broadhead which is wedge shaped creates a single slit wound, which can pull closed in elastic tissue. This lowers the fatality of the wound and causes a small blood trail, so that even if the wound is fatal, the animal may be difficult to track and find (wasting the kill).

In addition, the closure of the wound from a slit like opening also prevents the atmosphere from entering the chest cavity preventing lung collapse which causes the most rapid and ethical dispatch of game. A single slit like wound also creates increased drag on the arrow shaft and fletching decreasing the penetration of the arrow.

Accordingly, there is a need in the art for a broadhead design that overcomes the drawbacks of traditional broadhead designs.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a double single beveled broadhead. The double single beveled broadhead includes a first pair of blades. The first pair of blades are in a single plane, are opposite one another, forming a wedge shape and are both single beveled. The double single beveled broadhead also includes a second pair of blades. The second pair of blades are in a single plane, the plane of the second pair of blades is offset relative to plane of the first pair of blades by 90 degrees and are both single beveled. The double single beveled broadhead further includes an attachment, where the attachment allows the double single beveled broadhead to be attached to an arrow shaft.

Another example embodiment includes a double single beveled broadhead. The double single beveled broadhead includes a first pair of blades. The first pair of blades are in a single plane, are opposite one another, forming a wedge shape and are both single beveled. The double single beveled broadhead also includes a second pair of blades. The second pair of blades are in a single plane, the plane of the second pair of blades is offset relative to plane of the first pair of blades by 90 degrees and are both single beveled. The double single beveled broadhead further includes a tanto tip. The double single beveled broadhead moreover includes an attachment, where the attachment allows the double single beveled broadhead to be attached to an arrow shaft.

Another example embodiment includes a double single beveled broadhead. The double single beveled broadhead includes a first pair of blades. The first pair of blades are in a single plane, are opposite one another, forming a wedge shape and are both single beveled where the orientation of the bevel on each blade is the same as the orientation of the bevel on the other blade. The double single beveled broadhead also includes a second pair of blades. The second pair of blades are in a single plane, the plane of the second pair of blades is offset relative to plane of the first pair of blades by 90 degrees and are both single beveled where the orientation of each of the bevel matches the orientation of the bevels in the first pair of blades. The double single beveled broadhead further includes a transition, where the transition connects the beveled surface of one of the blades in the first pair of blades to the non-beveled side of an adjacent blade in the second pair of blades. The double single beveled broadhead moreover includes a tanto tip. The double single beveled broadhead also includes an attachment, where the attachment allows the double single beveled broadhead to be attached to an arrow shaft.

These and other objects and features of the present invention will become more fully apparent from the following description and appended claims or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
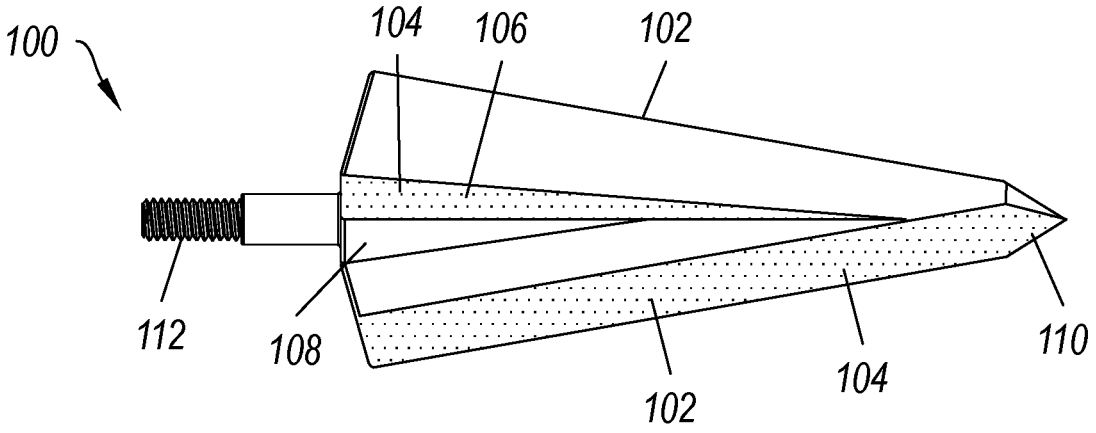
FIG. 1A is a top view of a large DSB broadhead.
Figure 1B:
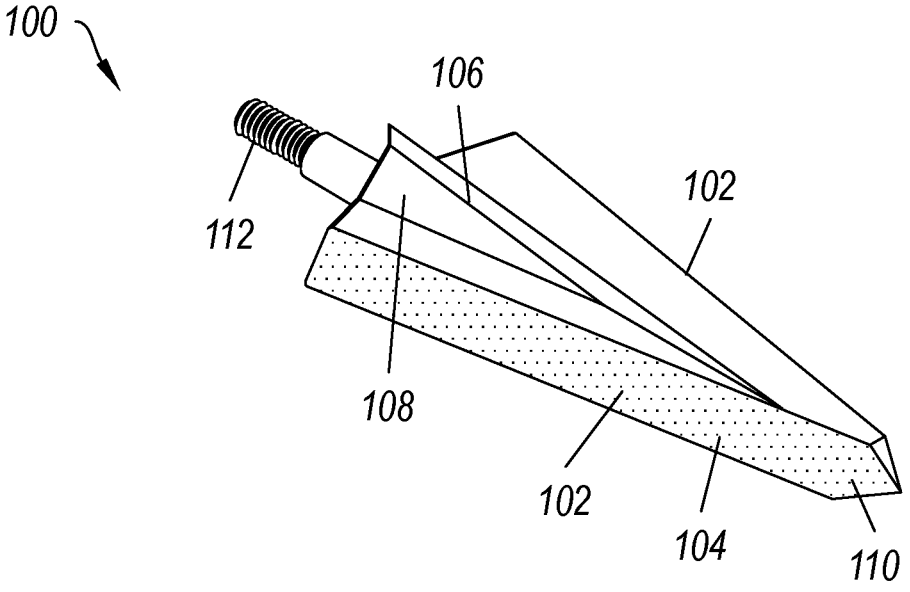
FIG. 1B is a perspective view of the large DSB broadhead.
Figure 1C:
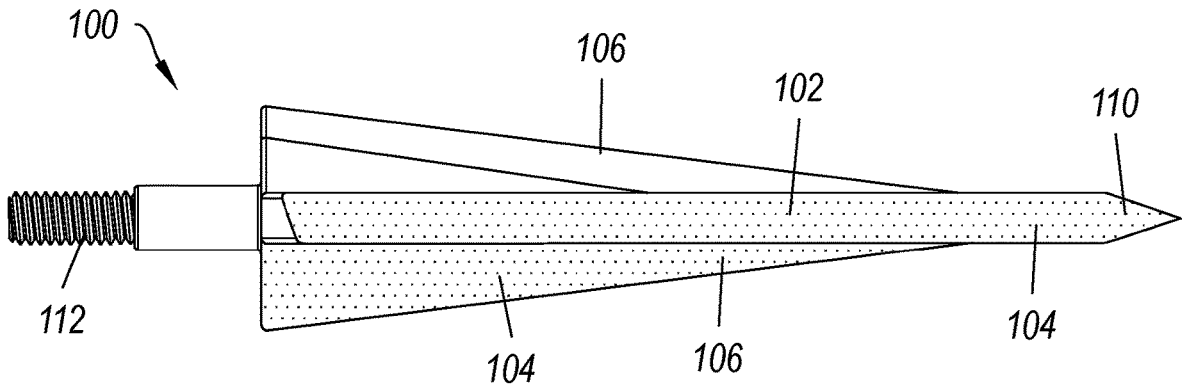
FIG. 1C is a side view of the large DSB broadhead.
Figure 1D:
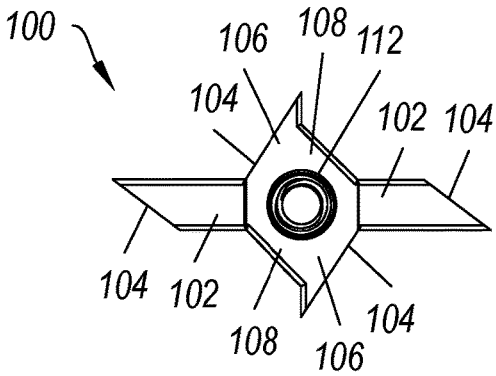
FIG. 1D is a rear view of the large DSB broadhead.
Figure 1E:
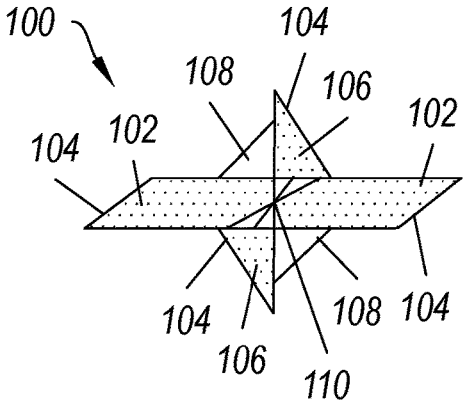
FIG. 1E is a front view of the large DSB broadhead.
Figure 2A:
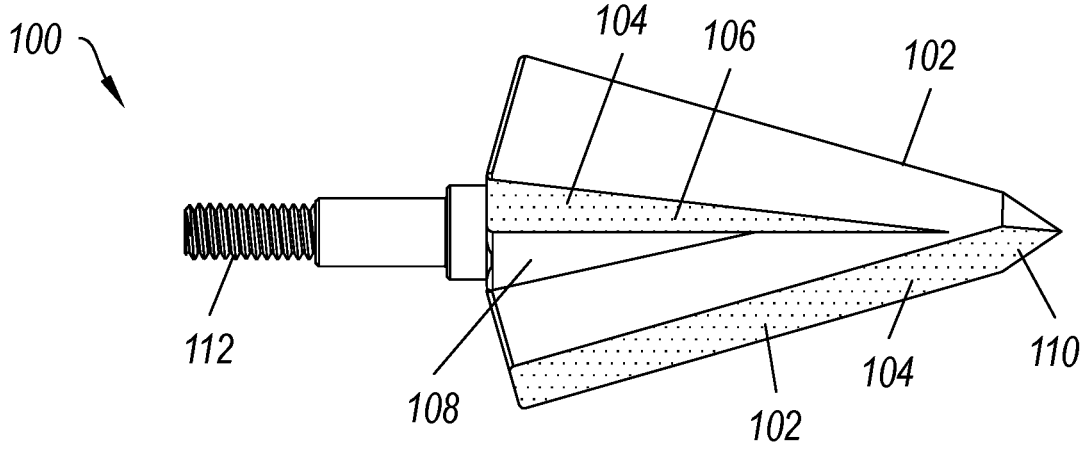
FIG. 2A is a top view of the small DSB broadhead.
Figure 2B:
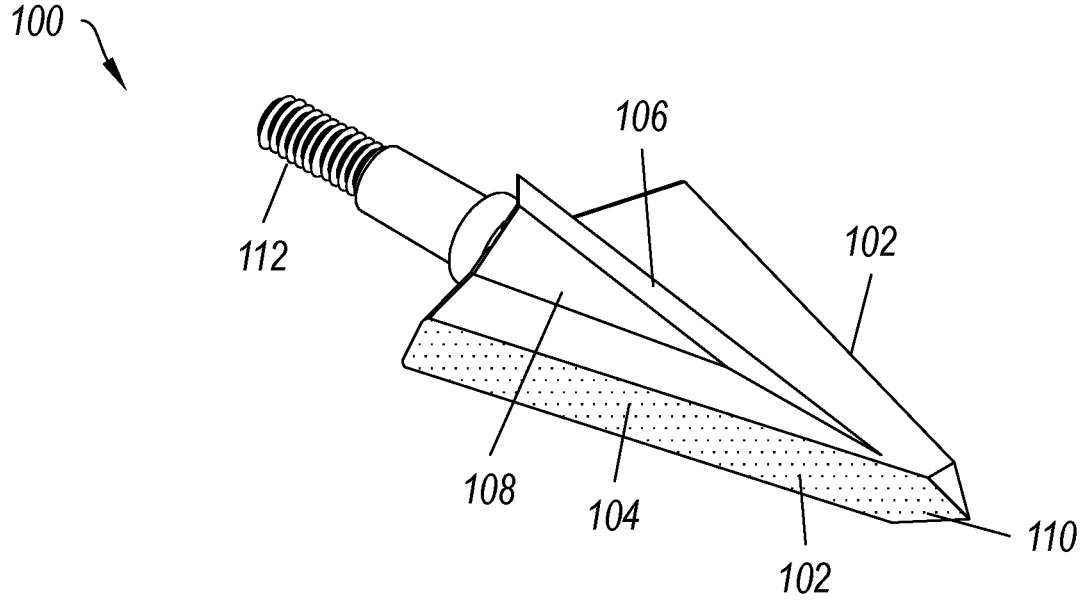
FIG. 2B is a perspective view of the small DSB broadhead.
Figure 2C:
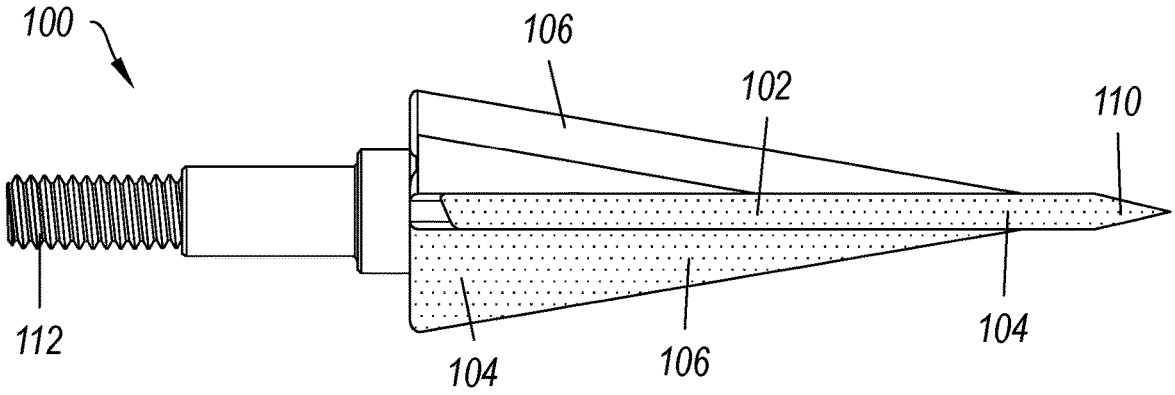
FIG. 2C is a side view of the small DSB broadhead.
Figure 2D:
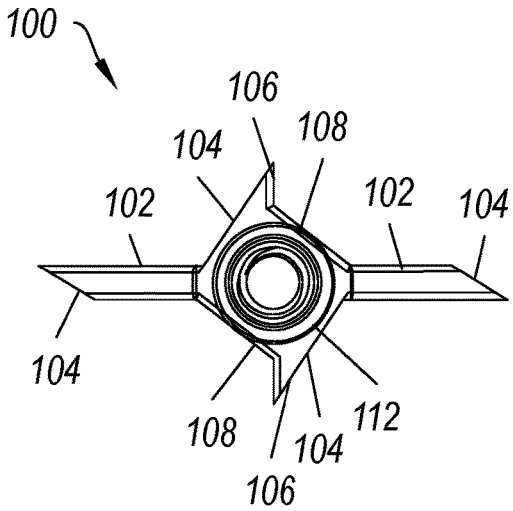
FIG. 2D is a rear view of the small DSB broadhead.
Figure 2E:
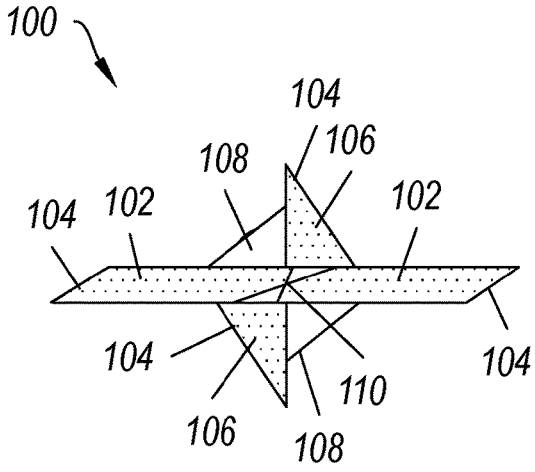
FIG. 2E is a front view of the small DSB broadhead.
Figure 3A:
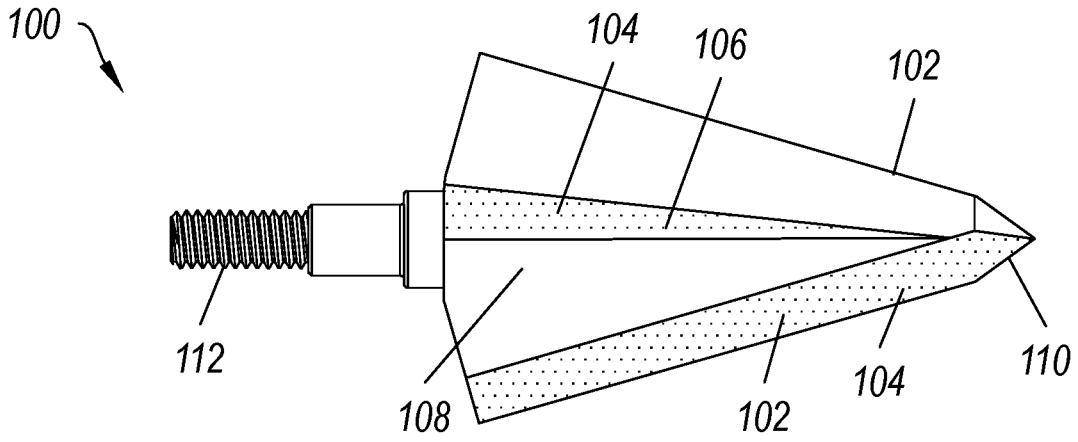
FIG. 3A is a top view of the streamlined DSB broadhead.
Figure 3B:
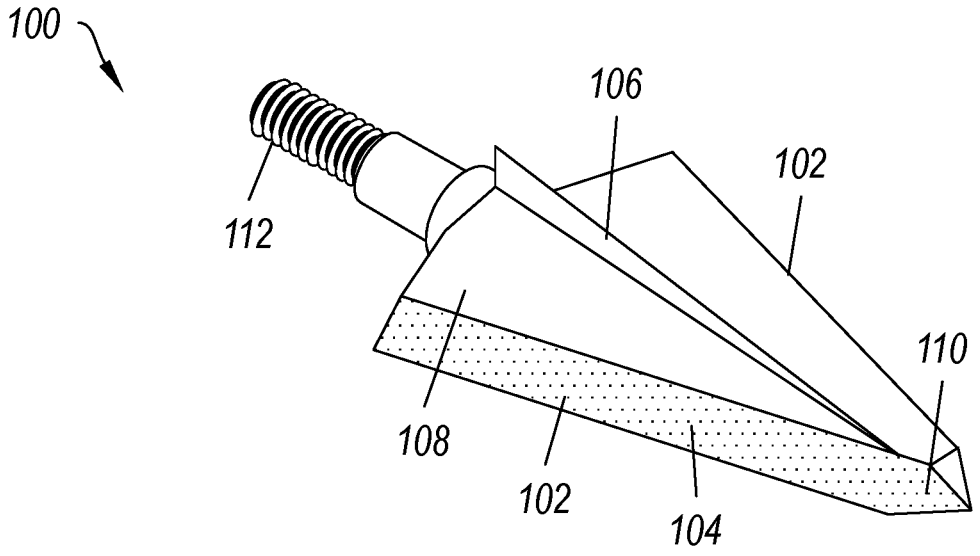
FIG. 3B is a perspective view of the streamlined DSB broadhead.
Figure 3C:
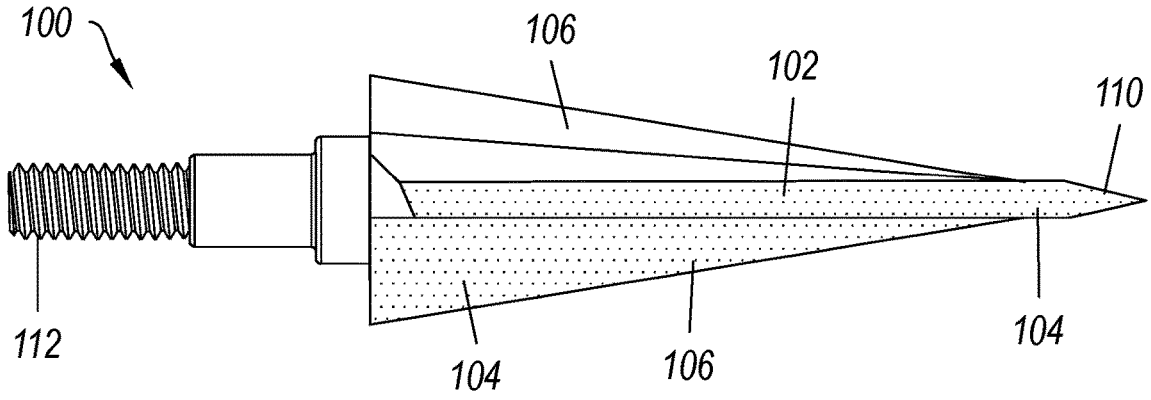
FIG. 3C is a side view of the streamlined DSB broadhead.
Figure 3D:
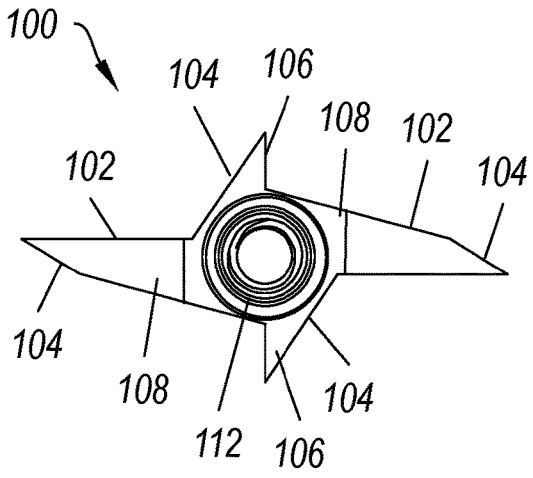
FIG. 3D is a rear view of the streamlined DSB broadhead.
Figure 3E:
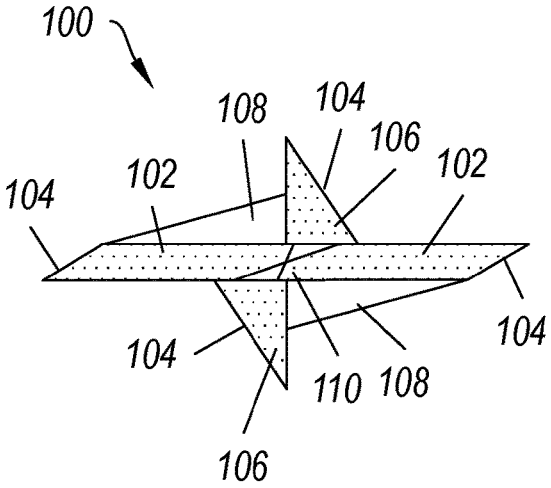
FIG. 3E is a front view of the streamlined DSB broadhead.

FIGS. 1A-1E (collectively "FIG. 1") illustrate an example of a large double single beveled broadhead 100 ("DSB broadhead 100"). FIG. 1A is a top view of the large DSB broadhead 100; FIG. 1B is a perspective view of the large DSB broadhead 100; FIG. 1C is a side view of the large DSB broadhead 100; FIG. 1D is a rear view of the large DSB broadhead 100; and FIG. 1E is a front view of the large DSB broadhead 100. FIGS. 2A-2E (collectively "FIG. 2") illustrate an example of a small DSB broadhead 100. FIG. 2A is a top view of the small DSB broadhead 100; FIG. 2B is a perspective view of the small DSB broadhead 100; FIG. 2C is a side view of the small DSB broadhead 100; FIG. 2D is a rear view of the small DSB broadhead 100; and FIG. 2E is a front view of the small DSB broadhead 100. FIGS. 3A-3E (collectively "FIG. 3") illustrate an example of a streamlined "DSB broadhead 100". FIG. 3A is a top view of the streamlined DSB broadhead 100; FIG. 3B is a perspective view of the streamlined DSB broadhead 100; FIG. 3C is a side view of the streamlined DSB broadhead 100; FIG. 3D is a rear view of the streamlined DSB broadhead 100; and FIG. 3E is a front view of the streamlined DSB broadhead 100. The large DSB broadhead 100 of FIG. 1, small DSB broadhead 100 of FIG. 2 and streamlined DSB broadhead 100 are for illustrative purposes only. I.e., they are showing different optimized configurations of a DSB broadhead, but other configurations are contemplated herein.

The DSB broadhead 100 has a number of advantages over traditional broadhead design. In particular, the DSB broadhead 100 has structural strength, has greater total cutting-edge length, has increased penetration, and results in a faster, more ethical kill during hunting. Broadheads can be made from steel or any other desired material and can include hardened edges. Broadheads have two to four sharp blades and are designed to deliver a wide cutting edge so as to kill as quickly as possible.

FIG. 1, FIG. 2 and FIG. 3 show that the DSB broadhead 100 has a first pair of blades 102. The first pair of blades 102 are in a single plane and form a wedge shape similar to traditional arrowheads. I.e., the blades in the first pair of blades 102 are in a single plane and have edges that are opposite one another. The first pair of blades 102 is designed to be as sleek as possible allowing for the greatest possible penetration (reduced drag leads to further penetration). Greater penetration helps cause a wound that will result in quicker death of the target animal.

This is achieved, at least in part, by the angle between the blades in the first pair of blades 102 which is critical to ensure penetration while maximizing tissue damage. I.e., if the blades in the first pair of blades 102 are parallel to one another, then penetration is increased, but the size of the wound is smaller, reducing tissue damage. Likewise, a very large angle between the two blades in the first pair of blades 102 increase the incision size but decrease penetration. In addition, the length and width of the DSB broadhead 100 are critical to ensure maximum tissue damage. The longer the DSB broadhead 100 the wider the wound, but the heavier the DSB broadhead 100. In addition, the wider the broadhead the larger the wound, but the larger the drag which decreases penetration. Finally, the weight of the DSB broadhead 100 changes the desired angle between the blades in the first pair of blades 102 for the most effect combination of wound size and penetration.

There is a balance between maximizing cutting surface while minimizing drag. The correct balance minimizes the energy and momentum needed to create a wound of game animals that has the highest degree of lethality. The DSB broadhead 100 was engineered to be sufficiently long to create slicing blades while maintaining structural integrity as not to bend or break upon impact. The more oblique the angle of any cutting blade the less force needed to cut any given material. Transition between slicing and chopping weighted blades occurs at ~45 degrees with a complete slicing edge (zero degree incident angle) and a complete chopping edge (90 degree incident angle). An optimal slicing broadhead edge angle is generally accepted as being less than 36.5 degrees (Ashby reports suggests a 3 to 1 ratio). Much experimentation has been done to obtain the optimal angle between the blades in the first pair of blades 102, the length of the first pair of blades 102, the width of the first pair of blades 102 to create all blade angles that are less than 36.5 degrees and still maintain structural integrity. Experimentation included varying test media from animal tissue to hard steel plate. Finally, all angles and designs were tested with live game animal with results compiled and refined.

These experiments have determined that for a larger DSB broadhead 100 the optimal angle between the blades in the first pair of blades 102 is between 16 and 20 degrees, the length of the cutting edge of the blades is between 65 and 66 millimeters and the maximum width between the two blades is between 25 and 30 millimeters to create maximum penetration and tissue damage. For example, the larger DSB broadhead 100 can have an angle between the blades in the first pair of blades 102 of approximately 19.85 degrees (i.e., each blade is 9.925 degrees from the major axis of the DSB broadhead 100), a length of the cutting edge of blades of approximately 65.2 mm and a maximum width between the two blades of approximately 30 millimeters. As used in the specification and the claims, the term approximate shall mean that the value is within 10% of the stated value, unless otherwise specified.

Further, these experiments had determined that for a smaller DSB broadhead 100 the optimal angle between the blades in the first pair of blades 102 is between 32 and 36.5 degrees, the length of cutting edge of the blades is between 36 and 38 millimeters and the maximum width between the two blades is between 25 and 27 millimeters to create maximum penetration and tissue damage. For example, the smaller DSB broadhead 100 can have an angle between the blades in the first pair of blades 102 of approximately 32 degrees (i.e., each blade is 16 degrees from the major axis of the DSB broadhead 100), a length of the cutting edge of the blades of approximately 37.6 mm and a maximum width between the two blades of approximately 27 millimeters.

Moreover, these experiments had determined that for a streamlined DSB broadhead 100 the optimal angle between the blades in the first pair of blades 102 is between 32 and 36.5 degrees, the length of the cutting edge of the blades is between 34.5 and 36.5 millimeters and the maximum width between the two blades is between 27 and 28 millimeters to create maximum penetration and tissue damage. For example, the streamlined DSB broadhead 100 can have an angle between the blades in the first pair of blades 102 of approximately 32 degrees (i.e., each blade is 16 degrees from the major axis of the DSB broadhead 100), a length of the cutting edge of the blades of approximately 36.12 millimeters and a maximum width between the two blades of approximately 27 millimeters.

FIG. 1, FIG. 2 and FIG. 3 also show that the first pair of blades 102 include a single bevel 104. A single bevel 104 blade is sharpened on only one side of each edge; the opposite edge remains flat. That is, only a single side is ground to create the cutting edge in a single bevel 104. In contrast a double bevel is when both sides are ground to create the blade.

A single bevel 104 blade will begin to "twist" or rotate upon impact due to the reaction of the single bevel 104 against meat or bone. This rotation creates and "S" shaped wound and increases the fatality of the wound and allows the broadhead 100 to break bone or other hard tissues if encountered. The rotation direction is determined by whether the single bevel 104 is a left bevel or a right bevel. The rotation is counterclockwise for a left bevel and clockwise for a right bevel. If the single bevel 104 is on the left looking from the base of the broadhead 100 to its point, it's a left bevel; if the bevel is on the right, it's a right bevel. The example shown in FIGS. 1, 2, and 3 are a right bevel (because the flat edge is on the bottom right in FIGS. 1D, 2D and 3D— likewise in FIGS. 1A, 2A and 3A when oriented with the tip toward the top, the ground edge is visible on the right).

The bevel angle between the flat edge and the ground edge can be critical to cut through tissue and create the desired rotation. The bevel angle in a larger DSB broadhead 100 can be between 35 and 40 degrees to create the desired rotation and penetration. For example, the bevel angle in a larger DSB broadhead 100 can be approximately 37.85 degrees. A smaller DSB broadhead requires a different bevel angle to create the desired rotation and penetration. In particular, the bevel angle in a smaller DSB broadhead 100 can be between 28 and 32 degrees to create the desired rotation and penetration. For example, the bevel angle in a smaller DSB broadhead 100 can be approximately 30 degrees. Likewise, a streamlined DSB broadhead requires a different bevel angle to create the desired rotation and penetration. In particular, the bevel angle in a streamlined DSB broadhead 100 can be between 28 and 32 degrees to create the desired rotation and penetration. For example, the bevel angle in a streamlined DSB broadhead 100 can be approximately 30 degrees.

The penetration benefits of a single bevel 104, fixed, two blade broadhead have been well established. For example, they break bone upon impact, they can pass completely through a target, and they cause higher amounts of blood loss. The disadvantages have also been identified. For example, two blade broadheads create little to no blood trails for standard fixed two blade broadhead. Fixed two blade broadheads create a single slit like opening that can quickly close to seal wound channels and skin openings. A DSB broadhead 100 retains these benefits without the drawbacks.

Likewise, the benefits of a single bevel 104, fixed, three and four blade broadhead designs are well known. More blades create a bigger entrance wound, which can increase the blood trail making a wounded animal easier to track. However, that comes at a cost of less penetration, meaning that the shot is less likely to lead to a quick kill. A DSB broadhead 100 retains the benefits of a larger entrance wound with deep penetration.

FIG. 1, FIG. 2 and FIG. 3 further show that the DSB broadhead 100 has a second pair of blades 106. The second pair of blades 106 is shorter than the first pair of blades 102 (which is different than a four blade broadhead) and are offset relative to the first pair of blades by 90 degrees. That is, the plane of the second pair of blades 106 is perpendicular to the plane of the first pair of blades 102, such that when viewed from the front or back of the arrowhead there are four blades spaced evenly around the main axis of the DSB broadhead 100, with one pair shorter than the other pair.

This is similar in some ways to "bleeder blades" in other broadhead types. Bleeder blades are being used as an add on to some fixed two blade broadheads which are not integral to the monolithic two blades currently on the market. The purpose is to create a larger wound that has a number of benefits. In particular, the bleeder blades cause a wound that is less likely to close leaving a small or non-existent blood trail. However, bleeder blades suffer a number of drawbacks. For example, bleeder blades are double beveled and are an add on, which means that they aren't supplementing the rotation of the broadhead 100 upon penetration and even fight against the rotation. Likewise, because bleeder blades are an add on, they can break off in the target leaving a sharp metallic object within the wound where it is now available to hurt the user. Furthermore, most bleeder blades are double bevel which tend to track straight and resist the rotation of the single bevel main blades. The secondary bleeder blades in the DSB design are in the same orientation (right single bevel in the examples) as the main blades to compliment the rotation induced by the larger main blades.

In contrast to (common or traditional) bleeder blades, the second pair of blades 106 is likewise single beveled, and the bevel 104 matches the bevel of the first pair of blades 102 (i.e., all four blades are all left beveled or all four blades are all right beveled). This ensures that the desired rotation is achieved and converts as much of the flight energy as possible into rotation and penetration. Likewise, the bevel angle of the second pair of blades 106 is the same (or nearly the same) as the bevel angle for the first pair of blades 102 so that the penetration and rotation caused by the first pair of blades 102 is complemented by the penetration and rotation of the second pair of blades 106. One of skill in the art will appreciate that the optimized bevel angle for a traditional single bevel broadhead will not be the same as the bevel angle for a DSB broadhead 100. This is because in the traditional single bevel broadhead there are two bevels which are creating the rotation and penetration, whereas in a DSB broadhead 100 there are four bevels which are creating rotation and penetration. This makes the bevel angle critical for correct operation.

Experimentation has shown that the second pair of blades allows for a 4-flap entrance and exit wound that cannot close like a single slit. This allows ambient atmosphere to enter the chest cavity causing the lungs to collapse. (In medical term this lung collapse is called pneumothorax and if both lungs sustain an open pneumothorax death rapidly ensues). If death is not immediate or rapid (i.e., if the wound is not "clean") then the blood trail is prominent and easy to follow.

These experiments have determined that for a larger DSB broadhead 100 the optimal angle between the blades in the second pair of blades 106 is between 12 and 15 degrees, the length of the cutting edge of the blades in the second pair of blades 106 (determined by the distance from the back of the blade to the intersection of the midline with the bevel on the main flat surface) is between 55 and 57 millimeters and the maximum width between the two blades in the second pair of blades 106 is between 15 and 18 millimeters to create maximum penetration and tissue damage. For example, the larger DSB broadhead 100 can have an angle between the blades in the second pair of blades 106 of approximately 14.3 degrees (i.e., each blade is 7.15 degrees from the major axis of the DSB broadhead 100), a length of the cutting edge of the blades in the second pair of blades 106 (56.24 mm edge length) of approximately 55.8 millimeters and a maximum width between the two blades in the second pair of blades 106 of approximately 17.90 millimeters.

Further, these experiments had determined that for a smaller DSB broadhead 100 the optimal angle between the blades in the second pair of blades 106 is between 17 and 19 degrees, the length of the cutting edge of the blades in the second pair of blades 106 is between 36 and 37 millimeters and the maximum width between the two blades in the second pair of blades 106 is between 12 and 14 millimeters to create maximum penetration and tissue damage. For example, the smaller DSB broadhead 100 can have an angle between the blades in the second pair of blades 106 of approximately 19.46 degrees (i.e., each blade is 9.73 degrees from the major axis of the DSB broadhead 100), a length of the cutting edge of the blades in the second pair of blades 106 of approximately 35.51 millimeters and a maximum width between the two blades in the second pair of blades 106 of approximately 13.86 millimeters.

Moreover, these experiments had determined that for a streamlined DSB broadhead 100 the optimal angle between the blades in the second pair of blades 106 is between 6 and 9.5 degrees, the length of the cutting edge of the blades in the second pair of blades 106 is between 36 and 37.5 millimeters and the maximum width between the two blades in the second pair of blades 106 is between 12 and 14 millimeters to create maximum penetration and tissue damage. For example, the streamlined DSB broadhead 100 can have an angle between the blades in the second pair of blades 106 of approximately 18.48 degrees (i.e., each blade is 16 degrees from the major axis of the DSB broadhead 100), a length of the cutting edge of the blades in the second pair of blades 106 of approximately 36.93 millimeters and a maximum width between the two blades in the second pair of blades 106 of approximately 13.86 millimeters.

One of skill in the art will appreciate that this means that the second pair of blades 106 is almost as long as the first pair of blades 102 or slightly longer in some configurations but has a smaller angle between the blades (and, consequently, a smaller maximum width). This results in the benefits of a four-slit wound while decreasing drag, which increases the amount of penetration. It has been previously determined that a 2-blade single bevel broadhead has the deepest penetration (Ashby reports) however the optimized penetration occurs when a minimal sharp blade is used to create a small slit versus blunt stretching for arrow shaft penetration that follows.

FIG. 1, FIG. 2 and FIG. 3 additionally show that the DSB broadhead 100 can include one or more transitions 108. The one or more transitions 108 connect the beveled surface of one of the blades in the first pair of blades 102 to the non-beveled side of an adjacent blade in the second pair of blades 106. The transition can extend all the way to the bevel 104 or only partway along the beveled surface. These transitions 108 provide a number of benefits. For example, the transitions 108 create a gradual, rather than sudden, increase in the overall cross-section of the broadhead as the wound cross section also increases as determined by the primary and secondary blades. This has the effect of eliminating the sudden resistance created as the trailing arrow encounters bone or tissue. Furthermore, the transition 108 of the DSB broadhead 100 is also on the single bevel 104 portion of the first pair of blades 102. This creates an additional rotational effect in the same direction as the single bevel of the first pair of blades 102 and of the second pair of blades 106.

FIG. 1, FIG. 2 and FIG. 3 moreover show that the DSB broadhead 100 can include a tanto tip 110. A tanto tip 110 is an angled tip that somewhat resembles a chisel point. The tip angles can vary between very steep and more swept back and can impact the overall tip strength. The main benefit of a tanto tip 110 is that it is designed for puncturing, initiating the wound on contact, and breeching bone while holding up to tough materials and not breaking. The tanto tip 110 is only a small percentage of the blades total cutting area; however, it is responsible for initiating and maintaining straight tracking and for bone breeching. The angles of the tanto tip 110 has all angles between the 36.5 degrees slicing weighted and 45 degree chopping weighted angles. These angles result in bone fracturing of the chopping angles while minimizing steep angle deflection of the slicing blades.

The tanto tip 110 is a pointed pyramidal double beveled edge that begins the penetration of the DSB broadhead 100. I.e., the tanto tip 110 is a small portion of the DSB broadhead 100 which creates an initial wound in the target. Two of the tanto tip 110 surfaces are the continuation of the opposing single bevels 104 in the first pair of blades 102. This allows the first pair of blades 102 and the second pair of blades 106 to more easily enter the animal while preserving the benefits of the single bevel 104. Thus, the single bevel 104 of the first pair of blades 102, the single bevel 104 of the second pair of blades 106, the transition 108 and the tanto tip 110 all work to create rotation, which maximizes tissue damage after penetration.

FIG. 1, FIG. 2 and FIG. 3 also show that the DSB broadhead 100 includes threads 112, which allows the DSB broadhead 100 to be attached to an arrow shaft. The Archery Manufacturers and Merchants Organization has standardized arrow/inserts/point attachment with the Interchangeable broadhead 100 standards. (AMO Standards Committee Field Publication FP3, 2000, page 14) (this standard can be viewed at http://peteward.com/AMOStandards.pdf, which is incorporated by reference herein in its entirety). This standard is that the threading 112 should be 8-32 (eight gauge and 32 threads per inch) with at least 11 full threads to allow for secure attachment. Following this standard allows a user to substitute DSB broadheads 100 for other broadheads.

Overall, the benefits of the DSB broadhead 100 design are as follows:

- The first pair of blades 102 and the second pair of blades 106 create a 4-flap entrance and exit wound that creates a blood trail unlike a two blade broadhead which produces a slit that easily seals the entrance and exit wounds.
- The smaller width of the second pair of blades 106 relative to the first pair of blades 102 provides deeper penetration. The smaller profile second pair of blades 106 has shown to penetrate deeper than a standard two blade broadhead with a noncutting ferrule but maintains the same structural integrity and rigidity.
- The second pair of blades 106 provides greater bone splitting and tissue penetration. The greater rotation after impact increases bone splitting ability. The first pair of blades 102 and the second pair of blades 106 create increased internal hemorrhaging.
- Two single bevels 104 (4 blades) increase the amount of rotation.
- The single bevel 104 creates rotation which causes more of a spiral wound channel and increases internal bleeding.
- The transitions 108 eliminate rough changes as the broadhead 100 penetrates. I.e., the transitions 108 increase penetration by reducing sudden change in the cross-sectional profile or contact surfaces and hence reducing vibration, yaw or drag.
- The tanto tip 112 had advantages over round, pyramidal, or flat/square ferrule tips to increase stiffness and to "stretch" tissue over the ensuing arrow shaft as it penetrates.
- The secondary single bevel blades reduce drag on the ferrule as it "slices" with blade edge at a very acute angle rather than stretching tissue.

The secondary single bevel blades "slice" with the blades running nearly the full length of the blade unlike most bleeder blades with a steep angle and "chop" rather than slice.

The DSB broadhead 100 design has penetrating advantages over 3 and 4 blade designs in that it has less overall blade resistance due to decreased cross-sectional area in relation to total cutting edge length and that all four blades are in the same single bevel orientation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A double single beveled broadhead, the double single beveled broadhead comprising:

a first pair of blades, wherein the first pair of blades:
- are in a single plane;
- are opposite one another, forming a wedge shape;
- are both single beveled, wherein the orientation of the bevel on each blade is the same as the orientation of the bevel on the other blade;

a second pair of blades, wherein the second pair of blades:
- are in a single plane;
- the plane of the second pair of blades is offset relative to plane of the first pair of blades by 90 degrees; and
- are both single beveled, wherein the orientation of each of the bevel matches the orientation of the bevels in the first pair of blades;

a transition, wherein the transition connects the beveled surface of one of the blades in the first pair of blades to the non-beveled side of an adjacent blade in the second pair of blades;

a tanto tip, wherein the tanto tip includes a double beveled edge; and an attachment, wherein the attachment allows the double single beveled broadhead to be attached to an arrow shaft.

2. The double single beveled broadhead of claim 1, wherein the bevels of the first pair of blades and the bevels of the second pair of blades are all right bevels.

3. The double single beveled broadhead of claim 1, wherein the bevels of the first pair of blades and the bevels of the second pair of blades are all left bevels.

4. The double single beveled broadhead of claim 1, wherein the angle between the blades in the first pair of blades is between 16 and 20 degrees.

5. The double single beveled broadhead of claim 4, wherein the angle between the blades in the first pair of blades is approximately 19.85 degrees.

6. The double single beveled broadhead of claim 1, wherein the angle between the blades in the first pair of blades is between 32 and 36.5 degrees.

7. The double single beveled broadhead of claim 6, wherein the angle between the blades in the first pair of blades is approximately 32 degrees.

8. The double single beveled broadhead of claim 1, wherein the length of the cutting edge of the blades in the first pair of blades is between 65 and 66 millimeters.

9. The double single beveled broadhead of claim 8, wherein the length of the cutting edge of the blades in the first pair of blades is approximately 65.2 millimeters.

10. The double single beveled broadhead of claim 1, wherein the length of the cutting edge of the blades in the first pair of blades is between 36 and 38 millimeters.

11. The double single beveled broadhead of claim 10, wherein the length of the cutting edge of the blades in the first pair of blades is approximately 37.6 millimeters.

12. The double single beveled broadhead of claim 1, wherein a maximum width between the blades in the first pair of blades is between 25 and 30 millimeters.

13. The double single beveled broadhead of claim 12, wherein the maximum width between the blades in the first pair of blades is approximately 30 millimeters.

14. The double single beveled broadhead of claim 1, wherein a maximum width between the blades in the first pair of blades is between 25 and 27 millimeters.

15. The double single beveled broadhead of claim 14, wherein the maximum width between the blades in the first pair of blades is approximately 27 millimeters.

16. The double single beveled broadhead of claim 1 wherein the blades in the first pair of blades are longer than the blades in the second pair of blades.

17. The double single beveled broadhead of claim 1 wherein the blades in the second pair of blades are longer than the blades in the first pair of blades.

18. The double single beveled broadhead of claim 1 wherein the attachment includes threading.

* * * * *